US007509927B2

(12) United States Patent
Mukomilow

(10) Patent No.: US 7,509,927 B2
(45) Date of Patent: Mar. 31, 2009

(54) HYDRAULIC HEADER FOR A HEATING SYSTEM

(75) Inventor: Dariusz Mukomilow, Meissen (DE)

(73) Assignee: Comfort-Sinusverteiler GmbH, Wettringen (DE)

( * ) Notice: Subject to any disclaimer, the term of this patent is extended or adjusted under 35 U.S.C. 154(b) by 501 days.

(21) Appl. No.: 11/339,394

(22) Filed: Jan. 25, 2006

(65) Prior Publication Data

US 2007/0170272 A1 Jul. 26, 2007

(51) Int. Cl.
*F22B 37/10* (2006.01)

(52) U.S. Cl. ..... 122/235.15; 122/511; 137/561 A; 237/8 R; 237/56

(58) Field of Classification Search ..... 122/235.15, 122/511, 235.31; 237/8 R, 56, 70; 137/561 A
See application file for complete search history.

(56) References Cited

U.S. PATENT DOCUMENTS 5,253,703 A * 10/1993 Master et al. ..... 165/82
5,316,384 A * 5/1994 Corso ..... 366/338
5,950,575 A * 9/1999 Simons et al. ..... 122/511
6,062,308 A * 5/2000 Flood ..... 166/52
6,460,568 B1 * 10/2002 Goodwin ..... 137/561 A
6,712,027 B2 * 3/2004 Rocheleau ..... 122/235.15

* cited by examiner

*Primary Examiner*—Gregory A Wilson
(74) *Attorney, Agent, or Firm*—Greer Burns & Crain Ltd

(57) ABSTRACT

A hydraulic header for a heating system includes a header housing having a vertical longitudinal axis in an installation position and a water chamber formed in an interior of the housing. A boiler inlet flow connection and a boiler return flow connection are provided at a vertical distance to one another on a first longitudinal side of the housing, and each communicate with the chamber. A consumer inlet flow connection and a consumer return flow connection are provided at a vertical distance to one another on an opposite longitudinal side of the housing, each communicating with the chamber, so that a boiler side and a heating circuit side are created in the housing. A dividing element is located in the chamber between the heating circuit side and the boiler side, and an upper and lower bypass between the heating circuit side and the boiler side are formed near a top end and a bottom end, respectively, of the housing.

18 Claims, 5 Drawing Sheets

A – A
46
48
46
26
44
43
47
A
A
42
46

44
46

HYDRAULIC HEADER FOR A HEATING SYSTEM

BACKGROUND OF THE INVENTION

The invention relates to a hydraulic header for a heating system, with an elongated header housing whose longitudinal axis runs vertically in the installation condition and whose interior forms a water chamber for the hot water of the heating system, with one boiler inlet flow connection and one boiler return flow connection each which are provided at a vertical distance to each other on the one longitudinal side of the header housing, and with one consumer inlet flow connection and one consumer return flow connection each which are provided at a vertical distance to each other on the other longitudinal side of the header housing so that one boiler side and one heating circuit side is created on the header housing.

DE 44 07 807 A1 discloses a heating system with one or several heating boilers which jointly supply consumers, wherein a hydraulic header—between inlet and return—is connected in the form of a long rectangular or round vessel with the inlet and, respectively, return nozzles being allocated to the two end areas. Connections of the inlet flow nozzles and the return flow nozzles are necked out in the connection area with the vessel wall. Triangular baffle plates are provided in the end areas of the nozzles.

U.S. Pat. No. 4,237,929 discloses a pipe manifold, especially for the inlet flow and return flow of hot water heaters, with an elongated manifold housing separated into an inlet and return flow chamber separated by a dividing wall in longitudinal direction, as well as with the line connections passed to the outside from the inlet flow chamber and the return flow chamber, said connections being aligned at least with their exterior ends in the longitudinal direction of the manifold housing. Openings communicating with the line connections are provided—offset to each other in longitudinal direction in the outside wall of the manifold housing—on both sides of a longitudinal edge of the dividing wall.

U.S. Pat. No. 6,092,734 discloses a manifold for connecting at least two circuits of a central heating system with a liquid heat transmission medium wherein the circuits each comprise one inlet flow line and one return flow line. A partition plate is provided in the manifold which essentially runs entirely through a hollow interior area and comprises several communicating openings. The manifold is horizontally provided in the installation position so that an upper and lower interior area of the manifold is formed.

U.S. Pat. Nos. 1,503,368; 4,248,378; 4,546,142; 5,316,384; 5,425,503 as a divisional application for U.S. Pat. Nos. 5,316,384; 5,738,277 and its continuation U.S. Pat. Nos. 5,829,677; 5,881,763 and 5,950,575 respectively relate to a heating system or, respectively, hot water heating systems with the allocated components.

A hydraulic header of the initially mentioned type is known from DE-Z Gasser, Walter: "Steuerung und Regelung von Mehrkesselanlagen" (Control and Regulation of Multi-Boiler Systems) in: IKZ-Haustechnik, H.6/1994, pages 66-70; page 68, illustration 4. Such a hydraulic header has the objective of ensuring the required hot water volume flows in the boiler circuit on the one side and in the consumer circuit (heating circuit) on the other side. Furthermore, the hydraulic header provides for a hydraulic decoupling of these circuits such that the header is practically without a pressure loss. This requirement is met with a flow velocity of a maximum of approximately 0.2 m/s at the nominal hot water volume flow. From this results a relatively large cross section of the interior of the hydraulic header. At the same time, the length of the hydraulic header—between the inlet flow connections on the one hand and the return flow connections on the other hand which are here provided at an offset opposite each other—should be triple to quadruple the diameter of the hydraulic header.

To achieve that the hydraulic header can be connected with a simplified installation to a pertinent heating system, the German utility model DE 20 2004 009 356 assigned to the assignee of the present invention proposes that the boiler inlet flow connection, relative to the consumer inlet flow connection, is provided offset toward the bottom.

Due to the fact that the boiler inlet flow connection is provided offset toward the bottom, relative to the consumer inlet flow connection, a smaller distance between the boiler inlet flow connection and the boiler return flow connection is advantageously achieved for an adjustment to small terminating spaces provided on the boiler side. DE 20 2004 009 356 yet also proved itself in practice such that—in the header between the boiler inlet flow connection and the boiler return flow connection—no short-circuit flow develops, by providing a dividing wall in the interior of the header housing. In the interior of the header housing, the dividing wall is connected with the boiler side and forms a channel so that the heated hot water coming from the boiler is conveyed—within the header housing—into its upper part, from the boiler inlet flow connection arranged relatively far below on the header housing.

SUMMARY OF THE INVENTION

The invention is based on the problem of further improving a hydraulic header for heating systems by simple means.

In accordance with the invention, the problem is solved by a dividing element provided in the interior, between the boiler side and the heating circuit side of the header housing, said dividing element ending at a distance from one top and one bottom end of the header housing so that a bypass is formed, or said dividing element featuring openings in the area of the upper and the lower end of the header housing so that a bypass is formed.

Due to the arrangement of the dividing element in accordance with the invention which can be preferably be designed as a dividing plate, it will be achieved that an improved hydraulic header is provided, wherein the different circuits are actually connected with each other but uncoupled on the pressure side, thus do not depend on each other. In a preferred embodiment, it is provided that the header housing comprises—seen in a longitudinal section—a quadrangular cross section, wherein the opposite longitudinal sides are connected with each other via lateral sides. Advantageously, the dividing element is connected with the lateral sides, preferably welded. Of course, it can also be provided that the header housing is formed of a tube which is round—seen in the longitudinal section—to which the heating circuit side and, respectively, the boiler side is assigned on the respectively opposite sides, with the dividing element being connected, preferably welded, with the interior wall of the tube, at an angular amount of preferably 90° to the corresponding heating circuit side and, respectively, the boiler side.

To achieve that return flow effects and mixing of the flows will be prevented, it is expedient in accordance with the invention that the dividing element, seen in longitudinal direction (vertical direction), is formed such that a diffuser effect is created in the bypass by the header. Due to the diffuser effect, there will be a pressure increase whereby the mentioned return flow effects and mixing of the flows can be advantageously prevented. Preferably, the dividing element features this advantageous embodiment in a lower area (return flow area) of the header housing.

It is expediently provided in accordance with the invention that the dividing element—seen in longitudinal direction (vertical direction)—is formed such that a nozzle effect is created in the bypass by means of the header, with a resulting velocity increase, whereby higher water throughputs can be achieved. Expediently, the dividing element is realized with this advantageous embodiment in an upper area (inlet flow area) of the header housing.

So that the flow resistance in the direction of passage of the dividing element remains as small as possible, it is advantageous in accordance with the invention that the dividing element—seen in longitudinal direction (vertical direction)—is formed such that curvatures are created. In a preferred embodiment, the dividing element—seen in longitudinal direction (vertical direction)—is sinusoidal in design, with the dividing element in the lower area of the header housing comprising a convex camber or curvature respectively in relation to the boiler side, and in the upper area, a concave camber or curvature respectively in relation to the boiler side. The cambers or, respectively, curvatures can also be designated as the change point of the flow.

To achieve that the flow of the hot water will be calmed and directed, and to simultaneously encourage gas separation, it is advantageously provided that the dividing element at its upper free end is formed such that gas or, respectively, air bubble nuclei will form and upper dead water areas are formed. In this embodiment, the flow of the hot water from the boiler inlet flow connection first meets the shaped area of the dividing element or, respectively, the concave area of the dividing element, thus causing the development of local low pressure areas which is approximately equivalent to shaking a closed bottle of mineral water where a corresponding bubble formation occurs. The flow breaks off at the edges of the dividing element which results in the formation of gas or, respectively, air bubble nuclei and in the formation of dead water areas. Due to the subsequent cross sectional expansion, the hot water is relieved and calmed whereby the gases dissolved in the water can be transferred into the gaseous phase and are able to rise. Preferably, the upper free end of the dividing element is bent away from the boiler side towards the heating circuit side and presents a quasi hook-shaped course.

However, not only the gas portions present in the hot water can be separated in the header housing but also the particle portions present in the hot water. To achieve this, it is expedient in accordance with the invention if the dividing element is formed, on its lower free end, such that the flow will be calmed and directed, thus encouraging a separation of dirt and particles. It is here expedient that the flow tears off at the edges, thus lower dead water areas will develop in which dirt or, respectively, the particles will sediment. Advantageously, the dividing element is bent on its bottom free end towards the boiler side, thus opposite to the upper free end and also presents a quasi hook-shaped course.

For a diversion of the separated gas portions, the header housing advantageously has, at its upper end, a ventilation sleeve, with the header housing at its lower end having a drainage sleeve for drawing off the dirt or, respectively, particle components.

So that dirt or, respectively, particle components can be more easily collected or, respectively, diverted, it is advantageously provided that the header housing, in its lower area, is allocated at least one sedimentation well which is formed by trapezoidal elements. The dividing walls (trapezoidal elements) of the sedimentation wells are continuously facing the flow and are thus exposed to the entire flow, and connected with the lower cover, from which the dividing walls rise towards the upper end of the header housing. Preferably, the dividing walls of the sedimentation wells or, respectively, of the at least one sedimentation well are centrically opened towards the cover or, respectively, the lower end of the header housing to divert contaminations by means of the drainage nozzle from all sedimentation wells or, respectively, from the at least one sedimentation well.

By means of the hydraulic header, a plant component will thus be made available which can serve as a hydraulic header and as an air separator and particle or, respectively, dirt separator. In this case, merely a simple dividing element is inserted in the header housing which—seen in longitudinal direction—can be straight or preferably shaped and which can have different lengths. Preferably, the dividing element or, respectively, the dividing plate can be designed sinusoidally—seen in longitudinal direction—with the dividing element in the return flow area of the header housing having a convex camber, relative to the boiler side. In the inlet flow area, in contrast, the dividing element has a concave camber, relative to the boiler side. On its free ends, the dividing element preferably has an opposite alignment in each case, with the upper free end being oriented towards the heating circuit side, and the lower free end being oriented towards the boiler side.

Additional advantageous embodiments of the invention are disclosed in the sub-claims and the following description of the figures. It is shown in:

BRIEF DESCRIPTION OF THE DRAWING

In the different figures, same parts are always provided with the same reference numbers so that, as a rule, they will also be described only once.

DETAILED DESCRIPTION OF THE PREFERRED EMBODIMENT

Figure 1:
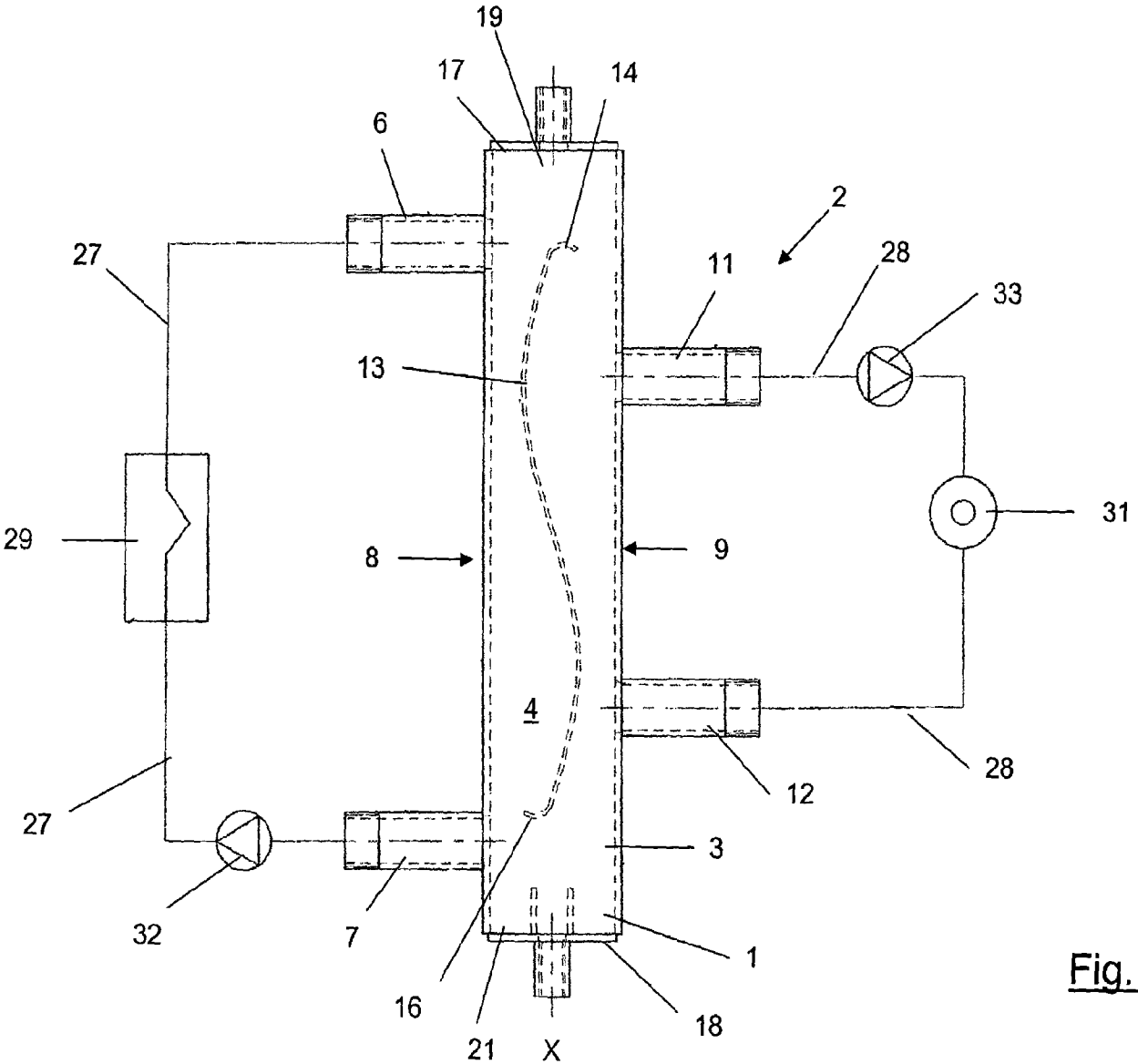
FIG. 1 is a schematic view of a hydraulic header in a heating system embodying the principles of the present invention.

FIGS. 1 to 4 show a hydraulic header 1 for a heating system 2 with an elongated header housing 3 whose longitudinal axis X runs vertically in the installation condition and whose interior 4 forms a water chamber for hot water of the heating system 2. The header housing 3 is provided with a boiler inlet flow connection 6 and a boiler return flow connection 7 which are arranged in a vertical distance to each other on one longitudinal side 8 of the header housing 3. The pertinent boiler connections 6 and, respectively, 7 are presented in an exemplary manner in FIGS. 1 and 2 on the left side of the header housing 3, with the longitudinal side 8 being designated as boiler side 8 in the following. On an opposite longitudinal side 9 of the header housing 3 facing the boiler side 8, one consumer inlet flow connection 11 and one consumer return flow connection 12 are each provided which are provided at a vertical distance to each other on the longitudinal side 9 of the header housing 3. In the following, the longitudinal side 9 of the header housing is designated as heating circuit side 9. Thus, a boiler side 8 and a heating circuit side 9 facing it are formed on the header housing 3.

In the interior 4 of the header housing 3, a dividing element 13 is provided between the heating circuit side 9 and the boiler side 8. In the embodiment presented in FIGS. 1 to 4, the dividing element 13 ends—with its free ends 14, 16 lying on the opposite side, seen in axial direction—at a vertical distance from one upper end 17 and, respectively, lower end 18 of the header housing 3 so that an upper bypass 19 and, respectively, a lower bypass 21 is formed. However, the dividing element 13 can also be brought up to the upper and, respectively, lower end 17 and, respectively, 18 of the header housing 3 and comprising openings there so that a bypass at each end will also be formed.

In the embodiment presented in FIGS. 1 to 4, the header housing 3 comprises a rectangular cross section—seen in a cross-sectional view—which is closed on the upper and the lower side. The header housing 3 comprises for example a rectangular tube section of steel to which one cover 24 and, respectively, 26 is welded to form one closed upper face end 22 and lower face end 23 each.

In FIG. 1, a complete heating system 2 is presented with the allocated hydraulic header 1. All connections 6, 7, 11 and 12 are designed as tubular nozzles which are inserted in a sealing manner—here welded in—into the corresponding openings of the header housing 3. On its free end, each connection 6, 7, 11 and 12 can each comprise a connecting flange, not presented, to the sealing connection of continuing pipings 27 and, respectively, 28, with the piping 27 being designed as the boiler piping and the piping 28 as the consumer piping. In the presented embodiment, the continuing pipings 27 and, respectively, 28 are welded with the corresponding connections 6, 7, 11 and 12 for example via a butt weld. The continuing pipings 27 provide, on the boiler side 8, the connection to one or several heating boilers 29. On the heating circuit side 9 of the hydraulic header 1, the continuing pipings 28 provide a connection with at least one consumer circuit which comprises in particular radiator 31 and/or service water heater 31. Between the heating boiler 29 and the boiler return flow connection 12, a pump 32 is provided, with one pump 33 also being provided on the other side, on the heating circuit side 9, between the consumer inlet flow connection 11 and the radiator 31 and/or the service water heater 31.

As FIGS. 1 to 4 show, the consumer inlet flow connection 11—relative to the boiler inlet flow connection 6—is offset seen in vertical direction (longitudinal direction X) toward the bottom, with the consumer return flow connection 12—relative to the boiler return flow connection 7—being offset, seen in a vertical direction (longitudinal direction X) toward the top. Thus, the connections 11 and 12 on the consumer side and, respectively, on the heating circuit side have a smaller vertical distance than the boiler side connections 6 and 7, respectively.

The dividing element 13 comprises a sinusoidal form—seen in vertical direction—with a convex camber or, respectively, curvature 36 being provided in the lower area 34 of the header housing 3, thus in a return flow area, relative to the boiler side 8; with a concave camber or, respectively, curvature 38 being provided in an upper area 37, thus in the inlet flow area, relative to the boiler side 8. In the presented embodiment, the boiler inlet flow connection 6 is provided, with its center axis Y1 approximately on the level of the upper free end 14 of the dividing element 13, with the boiler return flow connection 7 with its center axis Y2 being provided in the embodiment somewhat below the lower free end 16 of the dividing element 13. It can be clearly seen in FIG. 3 that the lower free end 16 is approximately on the level of an inside wall of the boiler return flow connection 7 so that the center axis Y2, relative to the lower free end 16, is offset by approximately one half diameter of the boiler return flow connection 7 towards the lower end 18. In the upper area 37 of the header housing 3, the consumer inlet flow connection 11 is provided with its center axis Y3 preferably in the zenith of the concave camber or, respectively, curvature 38, with the consumer return flow connection 12 being provided with its center axis Y4 preferably somewhat below the zenith of the convex camber or, respectively, curvature 36. The offset of the center axis Y4 is approximately one half diameter of the consumer return flow connection 12 towards the lower end 16 of the header housing 3. The center axes Y1 to Y4 are provided perpendicularly to the longitudinal axis X.

On its lower free end 16, the dividing element 13 is bent towards the boiler side 8 (FIG. 1). On the upper free end 14 facing it, the dividing element 13 is bent oppositely and oriented towards the heating circuit side 9.

Due to this design of the free ends 14 and, respectively 16 and due to the sinusoidal design of the dividing element 13 in accordance with the invention, the flow of the hot water in the header housing 3 will be calmed and directed, with gas separation of the gas portions in the hot water being encouraged at the upper end or, respectively, in the upper area 37 of the header housing 3—that is the inlet flow area. The dividing element 13 is formed in the upper area 37 of the header housing 3 such that the flow of the hot water from the boiler inlet flow connection 6 impinges on the dividing element 13 whereby local low-pressure areas are created. The flow tears off at the edges of the dividing elements which results in the formation of gas and, respectively, air bubble nuclei and dead water areas, with subsequent relieving and calming being achieved due to the expansion of the cross section whereby the gases dissolved in the hot water are transferred into the gaseous phase and are able to rise.

Due to the embodiment of the dividing element 13 in accordance with the invention, the same effect of flow calming and directing is achieved on the lower free end 16 or, respectively, in the lower area 34 of the header housing 3; here however, particle or, respectively, dirt components which may be present in the hot water can be separated. Here as well, the flow tears off at the edges of the dividing element 13, with dead water areas also being created in which dirt and, respectively, particle components will sediment.

Figures 2, 3, 4:
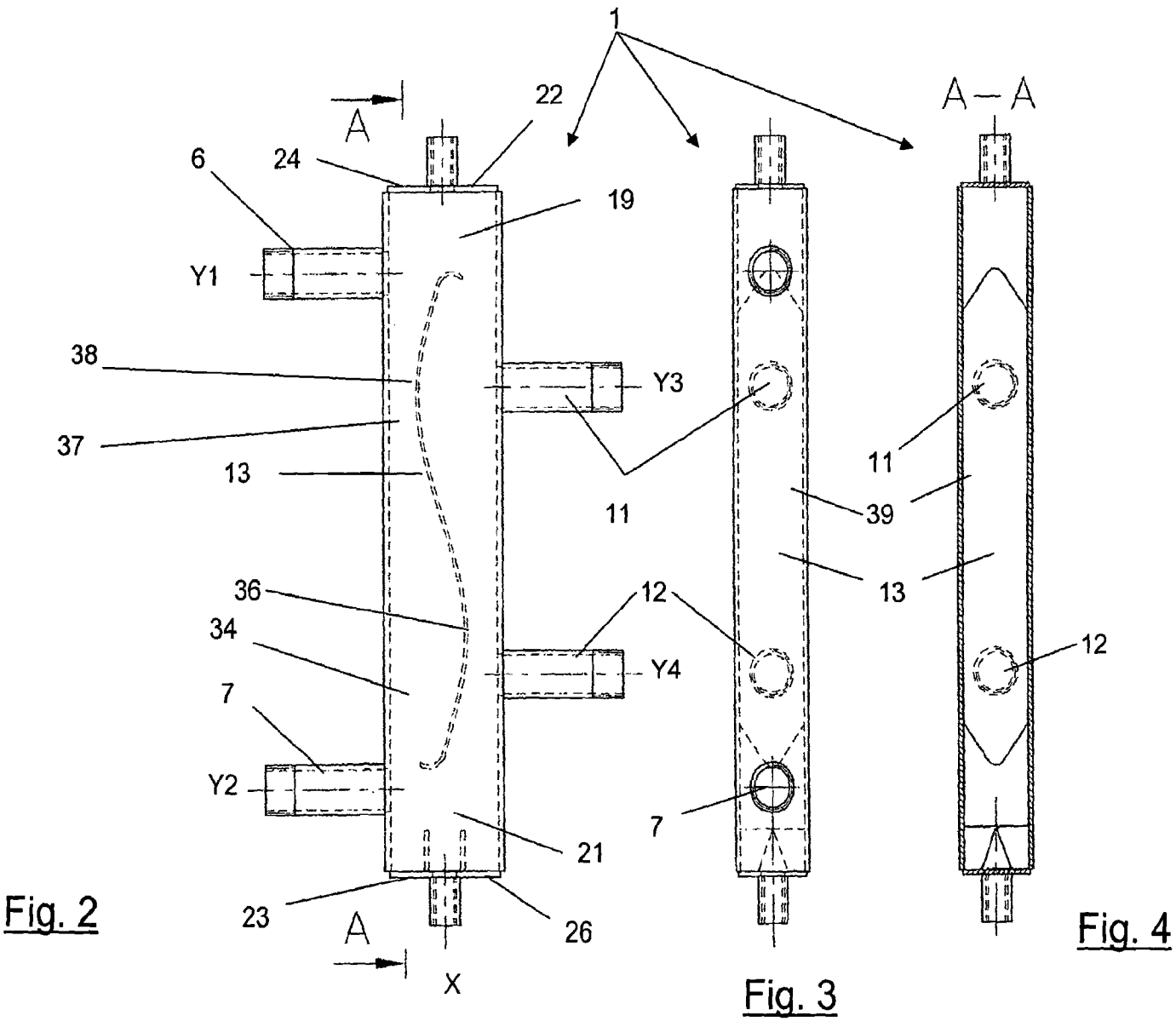
FIG. 2 is a side elevational view of the hydraulic header of FIG. 1 in isolation from the system in a view towards one transverse side.
FIG. 3 is a side elevational view of the hydraulic header of FIG. 2 viewed towards the boiler side.
FIG. 4 is a side sectional view of the hydraulic header of FIG. 2 taken generally along the section line A-A.
Figure 5:
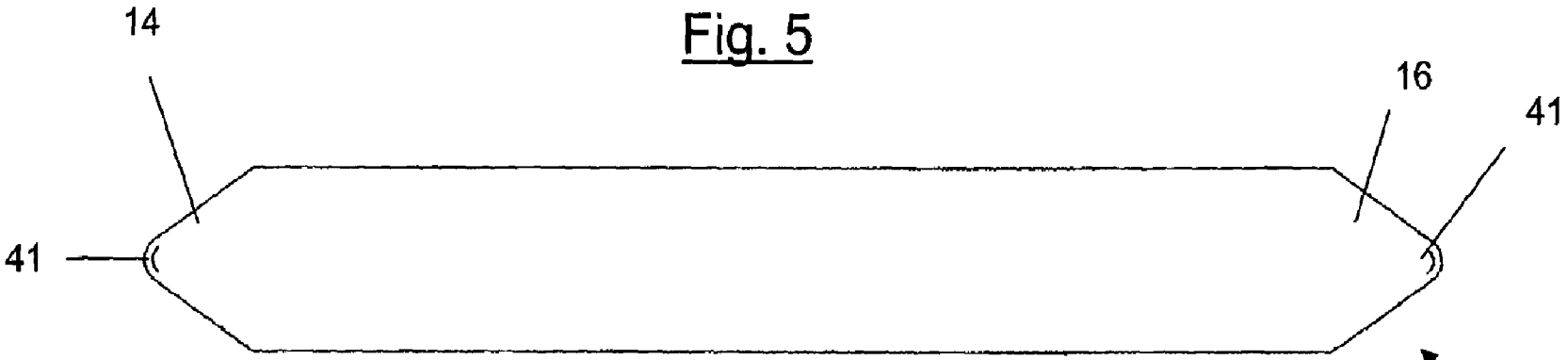
FIG. 5 is a front elevational view of a dividing element removed from the hydraulic header.
Figure 6:
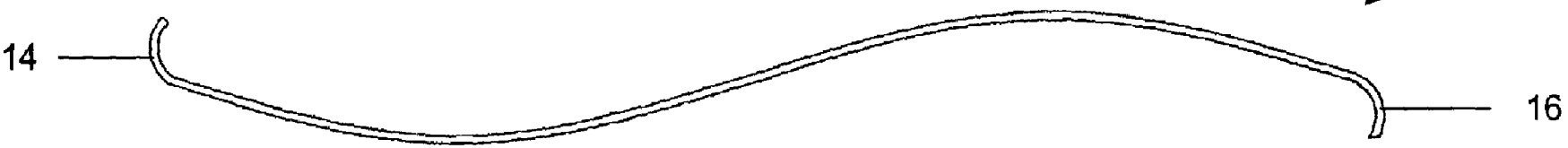
FIG. 6 is a side elevational view of the dividing element of FIG. 5.

In its transverse extension, the dividing element 13 corresponds approximately to an inside spacing from the transverse side walls 39 (FIG. 3, FIG. 4). Seen in a top view, the dividing element 13 (FIG. 5) is designed as an elongated, rectangular dividing plate which is conically designed on its free ends 14 and, respectively, 16, with one rounded off cone tip 41 being bent off, on the one hand, towards the heating circuit side 9 and, on the other hand, towards the boiler side 8 (FIG. 1). The cone tip 41, thus the corresponding free end 14 and, respectively, 16 forms a quasi hook-shaped course or shape, with the flow of the hot water being lead around an exterior circumference of the quasi hook-shaped cone tip 41.

In the upper bypass area 19, a nozzle effect (velocity increase) is generated due to the hydraulic header 1 and, respectively, due to the dividing element 13 whereby higher water throughputs can be achieved. In contrast, in the lower bypass area 21, a diffuser effect (pressure increase) will be generated by the dividing element 13 designed in accordance with the invention, whereby return flow effects and mixing of the individual flows are prevented. The dividing element 13—seen in longitudinal direction X or, respectively, in vertical direction—is shaped such that the cambers 36 and, respectively, 38 as the change point of the flow are provided such that the flow resistance effected by the cambers 36 and, respectively, 38 remains as small as possible in the direction of passage.

Figures 7, 8, 9:
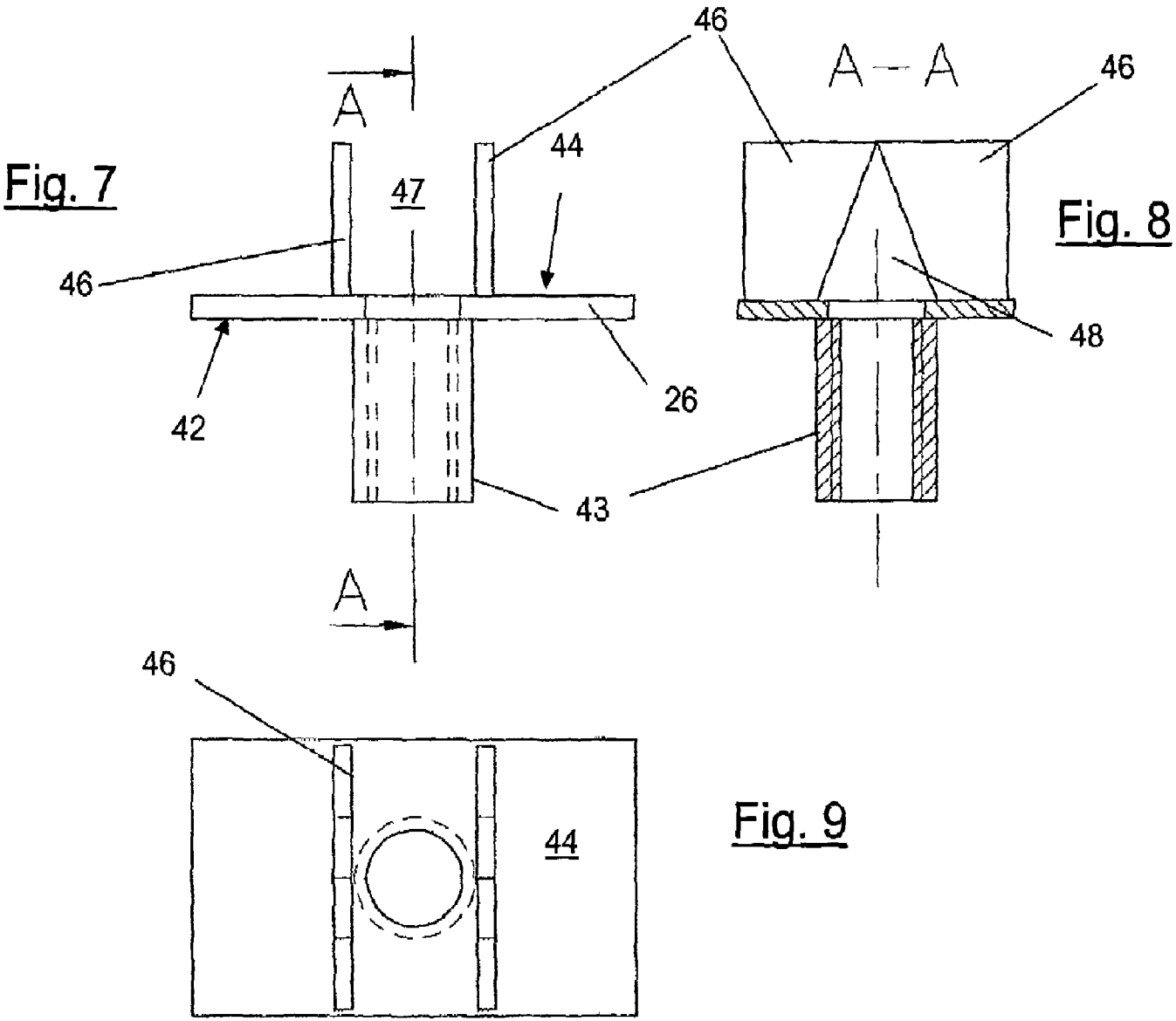
FIG. 7 is a side elevational view of a lower cover of the hydraulic header of FIG. 2.
FIG. 8 is a side sectional view of the lower cover of FIG. 7 general along section line A-A.
FIG. 9 is a plan view of the lower cover of FIG. 7.
Figure 11:
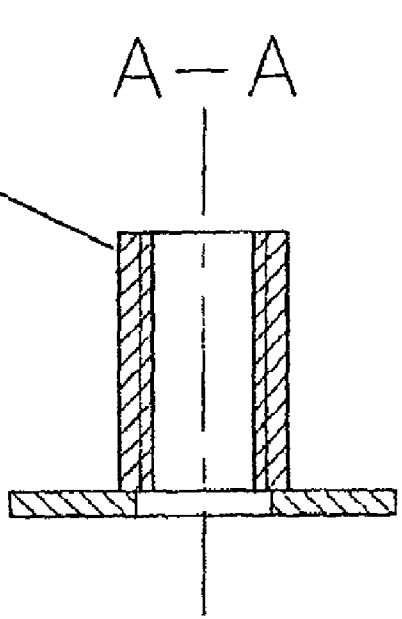
FIG. 11 is a side sectional view of the upper cover of FIG. 7 general along section line A-A.
Figure 10:
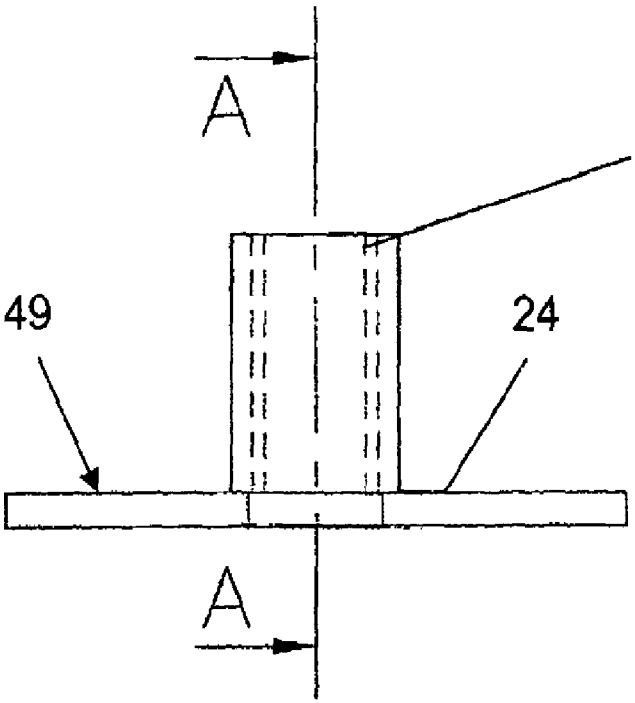
FIG. 10 is a side elevational view of a upper cover of the hydraulic header of FIG. 2.
Figure 12:
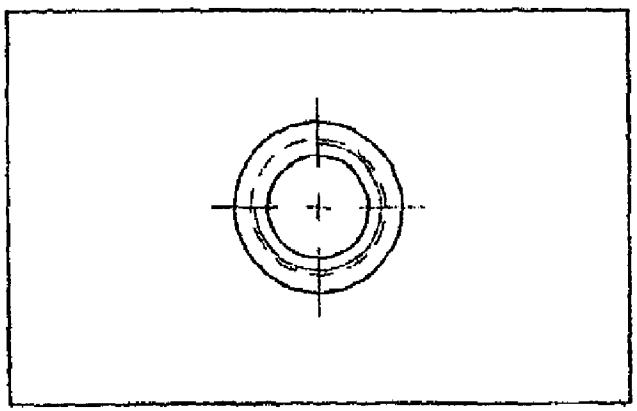
FIG. 12 is a plan view of the upper cover of FIG. 7.

In FIGS. 7 to 9, a bottom cover 26 of the header housing 3 is shown as a detail. On its outside 42, a drainage sleeve 43 is provided for the lower cover 26 so that the separated dirt and respectively, particle components can be easily drawn off. On an inside 44 facing the outside 42 of the lower cover 26, trapezoidal elements 46 are provided so that at least one sedimentation well 47 is created. The trapezoidal elements 46 form dividing walls of the sedimentation wells or, respectively, of the sedimentation well 47 and are continuously facing the flow and thus exposed to the entire flow of the hot water. The dividing walls of the sedimentation well or, respectively, wells 47 are centrically opened towards the cover 26 (opening 48) to discharge the separated particle and, respectively, dirt components by means of the drainage sleeve 43. FIG. 9 presents one view onto the inside 44 of the cover 26. In FIGS. 10 to 12, the upper cover 24 of the header housing 3 is presented as a detail. On one outside 49 of the cover 24, a ventilation sleeve 51 is provided so that the separated gas portions of the heating water can be removed.

It is self-evident that—in the upper and lower cover 24 and, respectively, 26—corresponding openings are provided so that the corresponding portions can be removed through the ventilation sleeve 51 or, respectively, through the drainage sleeve 43. The corresponding pipings can, of course, be connected to the pertinent sleeves 43, 51.

To avoid heat losses, the header housing 3 can finally be surrounded by a form-fitting jacket of a heat-insulating material. In this case of course, the pertinent connections 6, 7, 11, 12, 43 and 51 are passed through the jacket. The above mentioned pertinent connections 6, 7, 11, 12, 43 and 51 can also be protected against heat losses by means of their own insulating jackets which are here also not presented.

On the header housing 3, holding means can be provided on the rear side and/or on the underside, for a wall-mounted and/or pedestal-type fastening of the hydraulic header 1, with the holding means preferably being changeable in their distance. With these holding means, the hydraulic header 1 can be fastened in a simple manner, wherein the holding means—designed changeable in their distance—will also render possible an exact adjustment of the header housing 3, with regard to the pipings 27 and, respectively, 28 or connections to be connected with it on the boiler side and on the consumer side or, respectively, heating circuit side.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A hydraulic header for a heating system, with an elongated header housing whose longitudinal axis runs vertically in the installation condition and whose interior forms a water chamber for hot water of the heating system, with one boiler inlet flow connection and one boiler return flow connection each of which are provided at a vertical distance to the other on a first longitudinal side of the header housing, and with one consumer inlet flow connection and one consumer return flow connection each of which are provided at a vertical distance to each other on an opposite longitudinal side of the header housing so that one boiler side and, on the opposite side, one heating circuit side is created on the header housing, comprising:

a dividing element located in the interior of the header housing between the heating circuit side and the boiler side, an upper bypass between the heating circuit side and the boiler side formed near a top end of the header housing, and a lower bypass between the heating circuit side and the boiler side formed near a bottom end of the header housing.

2. A hydraulic header according to claim 1, wherein the upper bypass is formed by the dividing element ending at a distance from the top end of the header housing and the lower bypass is formed by the dividing element ending at a distance from the bottom end of the header housing.

3. A hydraulic header according to claim 1, wherein the upper and lower bypasses are formed by openings in the dividing element in the area of the upper and bottom ends of the header housing.

4. A hydraulic header according to claim 1, wherein the dividing element, seen in longitudinal direction, is shaped such that a diffuser effect is created in the lower bypass by the header.

5. A hydraulic header according to claim 1, wherein the dividing element, seen in longitudinal direction, is shaped such that a nozzle effect is created in the upper bypass by the header.

6. A hydraulic header according to claim 1, wherein the dividing element, seen in longitudinal direction, comprises a sinusoidal course.

7. A hydraulic header according to claim 1, wherein the dividing element comprises a convex camber in the lower area of the header housing relative to the boiler side and a concave camber in the upper area of the header housing relative to the boiler side.

8. A hydraulic header according claim 1, wherein the dividing element at its upper free end is formed such that gas or, respectively, air bubble nuclei will form and upper dead water areas are formed.

9. A hydraulic header according to claim 1, wherein the dividing element at its upper free end is bent away from the boiler side towards the heating circuit side.

10. A hydraulic header according to claim 1, wherein the dividing element at its lower free end is shaped such that dead water areas are created so that dirt or particle components present in the hot water are separable.

11. A hydraulic header according to claim 1, wherein the dividing element at its lower free end is bent towards the boiler side.

12. A hydraulic header according to claim 1, wherein the header housing comprises a ventilation sleeve at its upper end.

13. A hydraulic header according to claim 1, wherein the header housing comprises a drainage sleeve at its lower end.

14. A hydraulic header according to claim 1, wherein the header housing at its lower end area is allocated at least one sedimentation well which is formed by trapezoidal elements.

15. A hydraulic header according to claim 14, wherein the at least one sedimentation well comprises an opening towards the lower end of the header housing.

16. A hydraulic header for a heating system, comprising:

an elongated header housing having a vertical longitudinal axis in an installation position and having a water chamber formed in an interior of the housing for hot water of the heating system, a boiler inlet flow connection and a boiler return flow connection, each of which are provided at a vertical distance to the other on a first longitudinal side of the header housing, and each of which communicate with the water chamber, a consumer inlet flow connection and a consumer return flow connection, each of which are provided at a vertical distance to each other on an opposite longitudinal side of the header housing, and each of which communicate with the water chamber, so that a boiler side and, on the opposite side, a heating circuit side is created in the header housing, a dividing element located in the water chamber of the header housing between the heating circuit side and the boiler side, an upper bypass between the heating circuit side and the boiler side formed near a top end of the header housing, and a lower bypass between the heating circuit side and the boiler side formed near a bottom end of the header housing.

17. A hydraulic header according to claim 16, wherein the upper bypass is formed by the dividing element terminating at a distance from the top end of the header housing and the lower bypass is formed by the dividing element terminating at a distance from the bottom end of the header housing.

18. A hydraulic header according to claim 16, wherein the upper and lower bypasses are formed by openings in the dividing element in the area of the upper and bottom ends of the header housing.

* * * * *